United States Patent [19]

Fahrbach

[11] Patent Number: 4,966,337

[45] Date of Patent: Oct. 30, 1990

[54] MULTI-SPINDLE MACHINE FOR WINDING WIRE ON BOBBINS

[75] Inventor: Rudolf Fahrbach, Branchville, N.J.

[73] Assignee: Universal Manufacturing, N.J.

[21] Appl. No.: 352,867

[22] Filed: May 17, 1989

[51] Int. Cl.[5] ..... H01F 41/06

[52] U.S. Cl. ..... 242/7.09; 29/605

[58] Field of Search ..... 242/7.15, 7.17, 7.09, 242/7.13, 7.14, 7.18, 7.19, 7.11; 29/605, 596

[56] References Cited

U.S. PATENT DOCUMENTS

| | | | |
|---|---|---|---|
| 3,306,554 | 2/1967 | Henderson | 242/7.15 |
| 3,410,317 | 11/1968 | Rondas | 242/7.17 X |
| 3,713,599 | 1/1973 | Smith et al. | 242/7.09 X |
| 4,020,996 | 3/1977 | Deeg | 242/7.09 X |

FOREIGN PATENT DOCUMENTS

| | | | |
|---|---|---|---|
| 55-82425 | 6/1980 | Japan | 242/7.17 |

OTHER PUBLICATIONS

Adjustable Coil Winder Head, Western Electric Tech. Digest, No. 2, pp. 33–34, Apr., 1966, Sedlak.

*Primary Examiner*—Katherine A. Matecki

[57] ABSTRACT

A multi-spindle bobbin winding machine to wind a plurality, example, 4–8, bobbins simultaneously and to wind wire about the 2–16 terminals (tags) on each bobbin uses spinnable bobbin shafts with each bobbin position. Each wire feed nozzle is eccentrically mounted on a gear system driven by a gear rack. The rack is progressed, in one direction, to wind wire on the terminals and progressed in the opposite direction to wind wire on a parking pin.

6 Claims, 3 Drawing Sheets

MULTI-SPINDLE MACHINE FOR WINDING WIRE ON BOBBINS

BACKGROUND OF THE INVENTION

1. Field of the Invention

The present invention relates to wire winding of bobbins and more particularly to multi-spindle machines for winding wire about the terminals of bobbins.

2. Description of the Related Art

At the present time various bobbin wire winding machines are commercially available. In certain of these machines from 2 to 8 bobbins may be wound simultaneously.

In addition to winding the wire about the bobbins, the machines also wind wire about the extending terminals ("tags") of the bobbins. For example, each bobbin may have from 2 to 16 terminals, each of which must be wound with wire.

In such winding machines, the wire is wound about the bobbins at high speed; for example, the spindles rotate at 18,00 r.p.m. However, the wrapping of the terminals is relatively slow because the wire feed nozzles are moved in x, y and z directions to approximate a series of circles around each terminal. FIG. 1 shows the four-step movement, x and y movements, required to obtain one wire turn about a terminal. The machine operates under control of a programmed digital computer so that the series of movement commands may be less than a few milliseconds. However, the physical movement of the plate, on which the wire feed nozzles are mounted, is much slower, due to the mass of the x-y mechanism and the limitations on the speed of the step motors which drive the x-y system. For example, it may take two full seconds (2000 milliseconds) to obtain four turns of the wire about a terminal.

It has been observed, in some cases, particularly with bobbins having over four terminals, that it takes longer to wind the wire a few turns on each terminal than it does to wind the entire bobbin with wire.

Objectives and Features of the Invention

It is an objective of the present invention to provide a multi-spindle in-line bobbin wire winding machine which will wind the terminals of the bobbin at relatively high speed.

It is a further objective of the present invention to provide such a winding machine in which the apparatus to obtain such high-speed terminal winding is compact so that it is compatible with the limited space available in multi-spindle winding machines.

It is a further objective of the present invention to provide such a winding machine in which, at high speed, a large number of bobbin terminals, for example, 10–20 terminals on each bobbin may be accurately wound in a programmed sequence and with a programmed number of turns on each terminal.

It is a further objective of the present invention to provide such a winding machine in which the control of the terminal winding operation may be by the same digital computer used for the control of the other winding operations of the machine.

It is a feature of the present invention that a winding machine simultaneously winds wire on a plurality of bobbins. Each of the bobbins has a plurality of extending terminals, and the machine winds wire about the terminals. For example, the machine may wind wire on 2–20 bobbins with each bobbin having 2–30 terminals.

The machine includes a frame and a spindle means mounted on the frame and includes a plurality of rotatable spindles, each spindle being adapted to receive, hold and rotate a bobbin. Rotating means, for example, a high-speed motor and a drive train, rotates the spindles to wind wire on the bobbins. The machine also includes wire nozzle plate means slidable on the frame in the X, Y and Z directions relative to the frame and a plurality of hollow wire feed nozzles mounted on the plate means with a nozzle being associated with each spindle. Each nozzle feeds wire to a bobbin mounted on its associated spindle. Wire supply means feeds wire to each wire feed nozzle and plate control means, for example, a digital computer automatically moves the plate means in the X, Y and Z directions to position the wire feed nozzles relative to the bobbin terminals.

A gear rack, having an imaginary axis, is movable along its axis and is moved back-and-forth by motor means, preferably an air cylinder. A gear system means includes a plurality of gear trains with each gear train being in mesh with the gear rack so that the gears rotate in response to movement of the gear rack. Eccentric means eccentrically mounts each of the nozzles on a gear train so that the nozzles rotate about an imaginary axis in response to movement of the gear rack. The motor means moves the gear rack, thereby rotating the gear trains, in one direction, to wind a wire about a bobbin terminal.

It is a further feature of the present invention that each of the gear trains includes a first rotatable gear in mesh with the gear rack, a second rotatable gear connected to the first gear and rotatable therewith, a third rotatable gear in mesh with the second gear, and a rotatable gear train shaft fixed to the third gear. The wire feed nozzle is eccentrically connected to the gear train shaft.

SUMMARY OF THE INVENTION

In accordance with the present invention, there is provided a machine to simultaneously wind a plurality of bobbins, for example, 4–10 bobbins, with wire. The machine also winds wire about the protruding terminals ("tags") of each bobbin; for example, each bobbin may have 2–30 terminals.

Each empty bobbin is placed, either automatically or by hand on a spindle of the machine. The spindles rotate at high speed, for example, 1800 r.p.m. (revolutions per minute). The wire for each bobbin is individually fed from a wire supply over a series of guide wheels and through a hollow elongated tubular nozzle. The wire is wound around the bobbin when the spindle, and its bobbin, is rapidly rotated and the wire supply nozzle moves in one direction, generally lateral (Y direction).

The wire is wound about the terminals by (i) movement of the nozzle wire outlet head close to the terminal by X, Y and Z vertical movements and then (ii) rotation of the nozzle head around the terminal.

The nozzle is mounted eccentrically on a gear system so that the nozzle head traces an imaginary circle around each terminal to be wound, while the nozzle shank is rotated about its imaginary axis.

Each nozzle is eccentrically mounted on its own gear system and a gear of each gear system is simultaneously driven by an elongated gear rack which is preferably powered by a back-forth motion by an air cylinder.

When the gear rack is moved in one direction (forward) the gears rotate to spin the wire nozzle output head about a bobbin terminal. When the gear rack is moved in the opposite direction the gear system rotates in the opposite sense to spin the nozzle head about a parking pin in order to wind wire on the parking pin.

BRIEF DESCRIPTION OF THE DRAWINGS

Other objectives and features of the present invention will be apparent from the following detailed description taken in conjunction with the accompanying drawings. In the drawings:

FIG. 5B is a side view of the portion shown in FIG. 4;

DETAILED DESCRIPTION OF THE PREFERRED EMBODIMENTS

Figure 2:
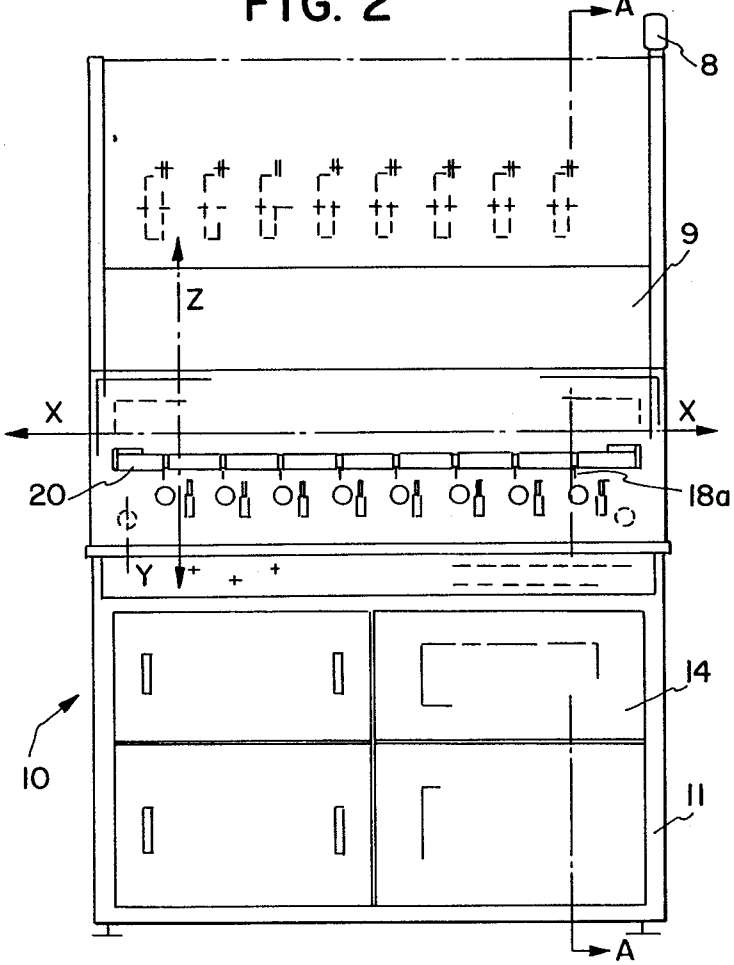
FIG. 2 is a front plan view of the multi-spindle wire winding machine of the present invention.

As shown in FIG. 2, the wire winding machine 10 of the present invention includes a frame (base) 11. A plurality, preferably 4–20, rotatable spindles 12 are mounted on the frame 11. The spindles are rotatable at high speed, for example, 18,000 rpm, by a motor 13. A programmable digital computer 14 controls the various below-described functions of the machine, including the starting and stopping of the motor 13, and consequently the spindles 12. For example, the computer 14 is a PCC (personal computer) which is an IBM-AT or, compatible therewith, having a hard disk (Winchester drive) of 10MB and a 16- or 32-bit microprocessor.

The wire supply is from the individual bins 15*a–k*, each bin containing the wire to be wound on the bobbin held on a single bobbin. Each wire 16*a–k* is led from its bin 15*a–k* over wire tensioning device 19*a–k* and a free-running guide pulley 17*a–k* and through a wire nozzle 18*a–k*. The wire nozzle generally is moved horizontally (or vertically) while the spindle is spinning to lay the wires on the bobbin in even layers. The wires are wound behind transparent sheet guard 9 and the signal lamp 8 warns of malfunctions.

The nozzles are carried by a nozzle carrier plate 20 which is movable relative to the frame in the X, Y and Z directions. The carrier plate is moved by stepper motors which are controlled by the computer 14.

Figure 7:
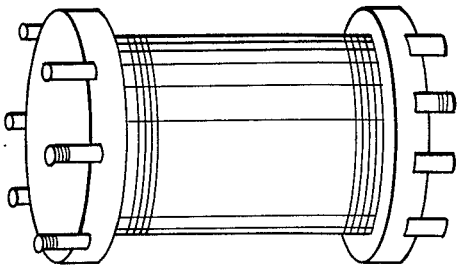
FIG. 7 is a perspective view of a typical bobbin to be wound with wire.
Figure 9:
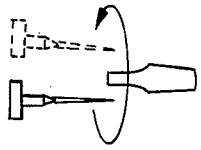
FIG. 9 is a front view of the movement of the wire nozzle of the present invention around a parking pin.
Figure 1:
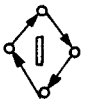
PRIOR ART FIG. 1
FIG. 1 is a diagram of the movement of a prior art wire nozzle around a bobbin terminal.
Figure 8:
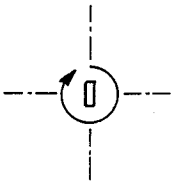
FIG. 8 is a top diagram of the movement of the wire nozzle of the present invention.
Figure 5A:
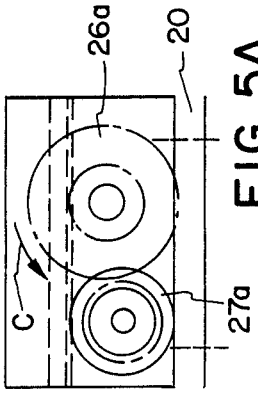
FIG. 5A is an enlarged top plan view of a portion of the machine shown in FIG. 4.
Figure 5A:
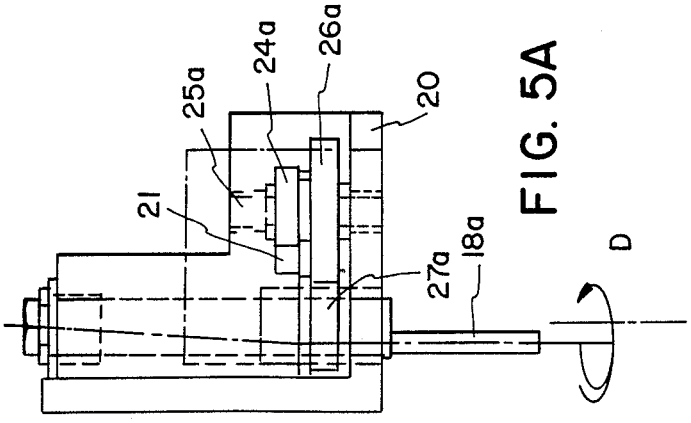
Figure 3:
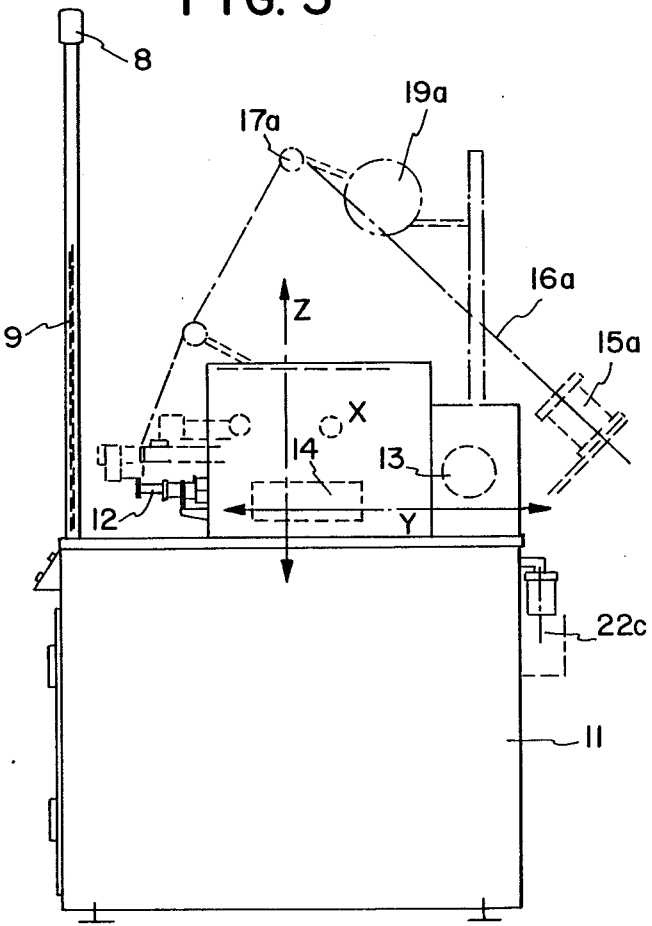
FIG. 3 is a cross-sectional view taken along line A—A of FIG. 2.
Figure 4:
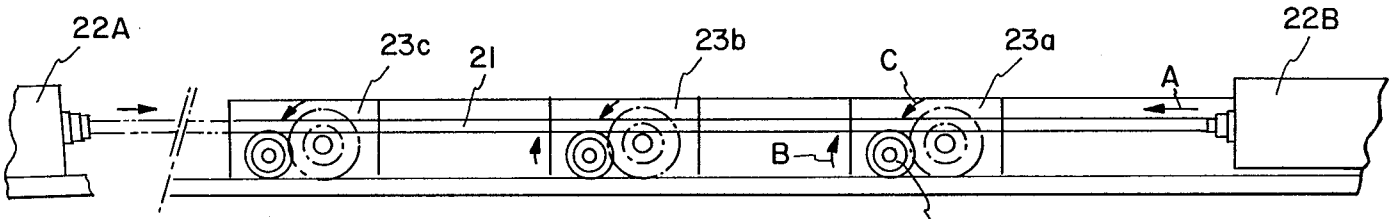
FIG. 4 is a top plan view of a portion of the winding machine of FIG. 2.

As shown in FIG. 4, a gear rack 21 extends from one air cylinder 22A to another 22B. The air cylinders each have an output piston which is extended under air pressure controlled by a valve from an air pressure supply. The valves are electromechanical air valves operated under control of the computer 14. The gear rack 21 is an elongated rectangular steel member, or other metal member, having gear teeth on one of its sides. The gear rack simultaneously drives the gear systems 23*a* etc. (only 23*a*–23*c* showing in FIG. 4). In each of the gear systems 23*a* ect. a gear 24*a* ect. is in mesh with the gear rack 21. The gears 24*a* ect. are mounted on shafts 25*a* ect. which also carry the gears 26*a* ect, which are in mesh with the gears 27*a* ect. The nozzles 18*a* ect. are eccentrically mounted on the gears 27*a* ect., see FIG. 5B.

When the gear rack 21 is moved in the direction of arrow A (FIG. 4) it rotates the gears in the directions B and C. In that direction the head 28*a* of the nozzle moves in a circle D (FIG. 5B) in order to wind the wire 16*a* about a terminal. After the terminal is wound the nozzles 18*a–k* are moved by movement of the carrier plate 20 until they are over parking pins. The gear rack 21 is moved in the direction opposite to arrow A, the gears rotate opposite to arrows B and C, and the nozzle head 18 moves in a circle opposite to arrow D. Such opposite rotation winds the wire onto the parking pin in the opposite direction than in the terminal. The carrier plate 20 is again moved until the nozzle head is adjacent the bobbin, to wind additional layers of wire on the bobbin, or is positioned adjacent another terminal, to wind wire about another terminal.

Figure 6:
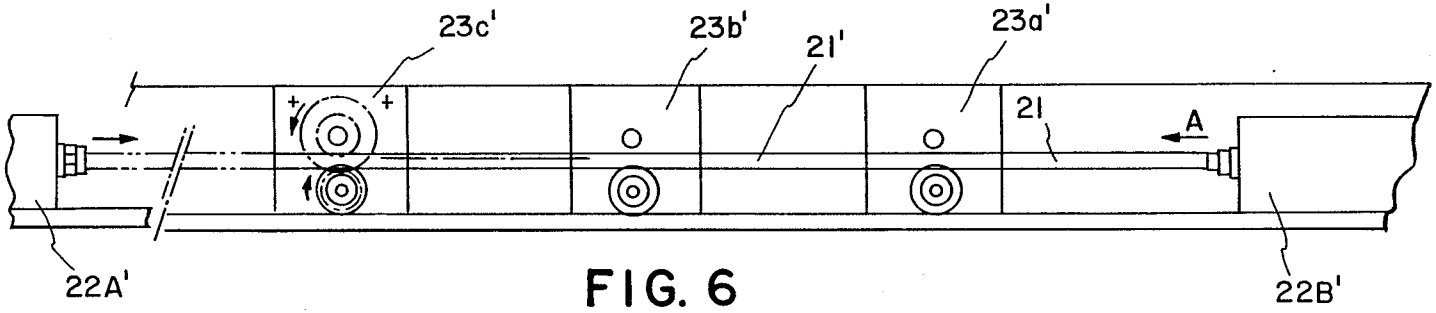
FIG. 6 is a top plan view of an alternative design.

FIG. 6 shows an alternative arrangement of the gears of the gear systems 23*a*' ect.

What is claimed is:

1. A winding machine to simultaneously wind wire on a plurality of extending terminals, the machine winding wire about said terminals, the machine including:

a frame, spindle means mounted on said frame and including a plurality of rotatable spindles, each spindle having means to receive and rotate a bobbin; a plurality of bobbins each having a plurality of bobbin terminals thereon and each removably mounted on one of said spindles;

rotating means to rotate the spindles to wind wire on the bobbins;

wire nozzle plate means slidable on the frame in a first direction and in a second direction perpendicular to the first direction;

a plurality of hollow wire feed nozzles mounted on the plate means with a nozzle being associated with each spindle, each nozzle feeding wire to a bobbin mounted on said associated spindle; a plurality of parking pins connected to the frame;

wire supply means to feed wire to each wire feed nozzle; and plate control means to automatically move the plate means in the first and second directions to position the wire feed nozzles relative to the bobbin terminals to be wound;

characterized in that the winding machine further includes:

a gear rack having an imaginary axis which is movable along said gear rack axis in a first direction and in a second direction opposite to said first direction;

motor means to move said gear rack back and forth along said gear rack axis;

gear system means including a plurality of gear trains with each gear train being in mesh with said gear rack and rotating in response to movement of said gear rack; and eccentric means to eccentrically mount each of said nozzles on one of said gear trains to rotate the nozzle about a nozzle imaginary axis in response to movement of the gear rack;

wherein said motor means moves said gear rack along said gear rack axis in the first direction to wind wire about a bobbin terminal and in the second direction to wind wire about a parking pin.

2. A winding machine as in claim 1 wherein each of said gear trains includes a first rotatable gear in mesh with said gear rack, a second rotatable gear connected to said first gear and rotatable therewith, a third rotatable gear in mesh with said second gear and a rotatable gear train shaft fixed to said third gear, wherein a wire feed nozzle is eccentrically connected to said gear train shaft.

3. A winding machine as in claim 1 wherein said plate control means includes a programmable digital computer.

4. A winding machine as in claim 3 wherein said computer controls the operation of said motor means.

5. A winding machine as in claim 1 wherein said motor means includes an air cylinder.

6. A winding machine as in claim 1 wherein said plate means further is movable in a third direction perpendicular to the plane of the first and second directions, and said plate control means moves said plate means in the third direction to position said nozzles.

* * * * *

UNITED STATES PATENT OFFICE

CERTIFICATE OF CORRECTION

Patent No. 4,966,337 Dated October 30, 1990

Inventor(s) Rudolf Fahrbach

It is certified that error appears in the above-identified patent and that said Letters Patent is hereby corrected as shown below:

Column 4, after line 26, insert the following:

-- The gear rack 21' is moved in the direction of arrow A by the air cylinder 22B' and it rotates the gear systems 23a', 23b', 23c' in one direction (counter-clockwise). Then the gear rack 21' is moved in the direction opposite to arrow A by the air cylinder 22A' and rotates the gear systems 23a', 23b', 23c' in the opposite direction (clockwise). --

Signed and Sealed this

Tenth Day of March, 1992

*Attest:*

HARRY F. MANBECK, JR.

*Attesting Officer*

*Commissioner of Patents and Trademarks*